US011932453B2

(12) United States Patent
Kozai et al.

(10) Patent No.: US 11,932,453 B2
(45) Date of Patent: Mar. 19, 2024

(54) INNER POUCH FOR CYLINDRICAL CONTAINER AND COMPOSITE CONTAINER USING SAME

(71) Applicant: OKURA INDUSTRIAL CO., LTD., Kagawa (JP)

(72) Inventors: Yukio Kozai, Kagawa (JP); Shu Kawakami, Kagawa (JP)

(73) Assignee: OKURA INDUSTRIAL CO., LTD., Kagawa (JP)

( * ) Notice: Subject to any disclaimer, the term of this patent is extended or adjusted under 35 U.S.C. 154(b) by 0 days.

(21) Appl. No.: 17/756,267

(22) PCT Filed: Nov. 25, 2020

(86) PCT No.: PCT/JP2020/043801
§ 371 (c)(1),
(2) Date: May 20, 2022

(87) PCT Pub. No.: WO2021/106927
PCT Pub. Date: Jun. 3, 2021

(65) Prior Publication Data

US 2022/0411134 A1 Dec. 29, 2022

(30) Foreign Application Priority Data

Nov. 26, 2019 (JP) ..... 2019-212828

(51) Int. Cl.
*B65D 33/02* (2006.01)
*B65D 33/16* (2006.01)
*B65D 77/04* (2006.01)

(52) U.S. Cl.
CPC ..... *B65D 33/02* (2013.01); *B65D 33/1608* (2013.01); *B65D 77/04* (2013.01)

(58) Field of Classification Search
CPC ..... B65D 33/02; B65D 33/608; B65D 77/04; B65D 331/608
(Continued)

(56) References Cited

U.S. PATENT DOCUMENTS 3,756,494 A * 9/1973 Becker, Jr. ..... B65D 25/14 229/4.5
3,800,994 A * 4/1974 Bowen ..... B65D 25/16 229/117.29
(Continued)

FOREIGN PATENT DOCUMENTS

AU 2012202849 A1 11/2012
CN 101028880 A 9/2007
(Continued)

OTHER PUBLICATIONS

Office Action dated Feb. 21, 2023 for the corresponding Chinese Patent Application No. 202080081789.1 with partial English translation.
(Continued)

*Primary Examiner* — Jes F Pascua
(74) *Attorney, Agent, or Firm* — Pearne & Gordon LLP

(57) ABSTRACT

Provided are a cylindrical container inner bag and a composite container using the cylindrical container inner bag for the purpose of easily filling the cylindrical container inner bag housed in a cylindrical container with a filler to the substantially same capacity as that of the cylindrical container. The cylindrical container inner bag formed in such a manner that one or more films folded back or overlapping with each other are closed at least at a right or left end portion or a lower portion has a filler housing portion and a support mechanism portion positioned below the filler housing portion. The support mechanism portion has a support
(Continued)

mechanism configured to regulate the position of the bottom of the inner bag in a cylindrical container.

9 Claims, 9 Drawing Sheets

(58) Field of Classification Search
USPC ..... 383/119, 121
See application file for complete search history.

(56) References Cited

U.S. PATENT DOCUMENTS

| | | | | |
|---|---|---|---|---|
| 9,067,718 | B2 | 6/2015 | Koland et al. | |
| 9,573,747 | B2 | 2/2017 | Koland et al. | |
| 9,856,063 | B1 * | 1/2018 | Schulz | B65D 31/10 |
| 2006/0140514 | A1 | 6/2006 | Dierl et al. | |
| 2008/0054024 | A1 | 3/2008 | Kubota | |
| 2014/0339258 | A1 | 11/2014 | Koland et al. | |
| 2015/0321820 | A1 | 11/2015 | Koland et al. | |

FOREIGN PATENT DOCUMENTS

| | | | | |
|---|---|---|---|---|
| CN | 101035628 | A | | 9/2007 |
| CN | 102785825 | A | | 11/2012 |
| CN | 103998347 | A | | 8/2014 |
| GB | 1104204 | A | * | 2/1968 |
| JP | H03-49945 | A | | 3/1991 |
| JP | H03-81854 | U | | 8/1991 |
| JP | H06-171601 | A | | 6/1994 |
| JP | H07-047337 | Y2 | | 11/1995 |
| JP | H08-244845 | A | | 9/1996 |
| JP | 2003-335366 | A | | 11/2003 |
| JP | 2004-033103 | A | | 2/2004 |
| JP | 2005-162239 | A | | 6/2005 |
| JP | 2006-264698 | A | | 10/2006 |
| JP | 2006-341876 | A | | 12/2006 |
| JP | 4191432 | B2 | | 9/2008 |
| JP | 2010-253871 | A | | 11/2010 |
| JP | 2014-037259 | A | | 2/2014 |
| JP | 2016-069026 | A | | 5/2016 |

OTHER PUBLICATIONS

International Search Report dated Jan. 19, 2021 filed in PCT/JP2020/043801.

Office Action dated Aug. 3, 2023 for the corresponding Chinese Patent Application No. 202080081789.1.

Office Action (Reconsideration Report by Examiner before Appeal) dated Sep. 1, 2023 for the corresponding Japanese Patent Application No. 2021-561450.

European Search Report dated Nov. 30, 2023 for the corresponding European Patent Application No. 20892992.7.

* cited by examiner

INNER POUCH FOR CYLINDRICAL CONTAINER AND COMPOSITE CONTAINER USING SAME

TECHNICAL FIELD

The present invention relates to an inner bag used for a relatively-large capacity metal or plastic cylindrical container such as a tank or a drum and a composite container using the inner bag.

BACKGROUND ART

Typically, in a case where a relatively-large capacity cylindrical container such as a tank or a drum is filled with liquid such as a drug, an inner bag formed of a film is sometimes used for the purpose of preventing contamination of the inside of the cylindrical container with the filler. The inner bag is inserted into the cylindrical container in advance. The cylindrical container is not directly filled with the filler, but the inner bag in the cylindrical container is filled with the filler. Thus, the cylindrical container can be repeatedly used only by replacement of the inner bag without the need for washing the cylindrical container after the contents have been discharged, and therefore, the cylindrical container housing the inner bag has been broadly used.

For example, as the inner bag, a flat inner bag 21 formed in such a manner that two films 22 are closed at a peripheral edge (right and left end portions 23 and a bottom 24) thereof as shown in FIG. 9 is used. The width of the inner bag is substantially the half of the inner circumferential length of the cylindrical container, and the capacity of the inner bag is the substantially same as the capacity of the cylindrical container. A film thickness is about 0.01 to 0.5 mm. Force applied to the inner bag due to the weight of the filler is received by the container, and therefore, the inner bag is not damaged due to the weight of the filler in a normal case.

In the case of filling the inner bag housed in the cylindrical container with the filler, the inner bag is first inserted into the cylindrical container. As described above, the width of the inner bag is substantially the half of the inner circumferential length of the cylindrical container. That is, the inner bag is a flat bag having a width longer than the inner diameter (or the diameter) of the cylindrical container, and therefore, the inner bag is housed with the center of the bottom of the inner bag being bent (in a U-shape or a S-shape as viewed in plane) on the bottom of the cylindrical container. When the inner bag is filled with the filler in this state, the bent state of the bottom of the inner bag is maintained when a side surface (or front and back surfaces) of the inner bag is pushed out and expanded due to the weight of the filler. A lower portion of the inner bag cannot be sufficiently expanded in the cylindrical container, and the inner bag tilts and leans on the cylindrical container. For this reason, the inner bag cannot be fully filled with the filler. When an attempt is made to fill the inner bag housed in the cylindrical container with the filler to the substantially same capacity as that of the cylindrical container (90% to 100% of the capacity of the cylindrical container), it is necessary to lift the inner bag filled with the filler to unbend the vicinity of the center of the bottom of the inner bag and adjust the position of the bottom of the inner bag onto the center of the bottom of the cylindrical container. This leads to a probability that the films are stretched and ruptured due to the weight of the filler upon lifting.

In response to such a problem, Patent Literature 1 describes, as a container inner bag, that a lower portion of an inner bag is in a trapezoidal shape narrowed toward the lower side of the inner bag, the length of the short side of the trapezoidal shape is 0.8 to 1.2 times as great as the inner diameter of a container, and the height of the trapezoidal shape is 0.4 to 0.6 times as great as the inner diameter of the container. Moreover, Patent Literature 1 describes that this configuration avoids bending of the lower portion of the inner bag upon insertion of the inner bag into the container and allows the inner bag to be positioned on the substantially center of the bottom of the container.

CITATION LIST

Patent Literature

PATENT LITERATURE 1: JP-UM-B-7-47337

SUMMARY OF THE INVENTION

Problems to be Solved by the Invention

However, even in a case where the inner bag is configured such that the lower portion thereof is in the trapezoidal shape narrowed toward the lower side, a portion of the inner bag from the top to the middle thereof is housed in a bent state. For this reason, the bottom of the inner bag is, upon insertion, bent to follow bending of the portion of the inner bag from the top to the middle thereof, and the lower portion of the inner bag cannot be sufficiently expanded in the cylindrical container. Moreover, the bottom of the inner bag is bent, and for this reason, is positioned on a location slightly shifted from the center of the bottom of the cylindrical container. For this reason, when filled with the filler, the inner bag tilts and leans on the cylindrical container, and therefore, the inner bag housed in the cylindrical container cannot be filled with the filler to the substantially same capacity as that of the cylindrical container.

The present invention has been made in view of these problems, and an object of the present invention is to provide a cylindrical container inner bag which can be easily filled with a filler to the substantially same capacity as that of a cylindrical container in a state in which the inner bag is housed in the cylindrical container without the need for the process of lifting the inner bag filled with the filler to unbend the bottom of the inner bag and adjusting the position of the bottom of the inner bag onto the vicinity of the center of the bottom of the cylindrical container and a composite container using the cylindrical container inner bag.

Solution to the Problems

The present invention provides:

(1) a cylindrical container inner bag formed in such a manner that one or more films folded back or overlapping with each other are closed at least at a right or left end portion or a lower portion, the cylindrical container inner bag including a filler housing portion and a support mechanism portion positioned below the filler housing portion, the support mechanism portion having a support mechanism configured to regulate the position of the bottom of the inner bag in a cylindrical container;

(2) the cylindrical container inner bag according to (1), in which the support mechanism portion has a support mechanism including a bar-shaped support member in a housing space;

(3) the cylindrical container inner bag according to (1), in which the support mechanism portion has a support mechanism including a bar-shaped support space formed in such a manner that a hermetic space is expanded by an internal pressure;

(4) the cylindrical container inner bag according to (1), in which the support mechanism portion has a support mechanism including a bar-shaped support member outside or inside the vicinity of the bottom of the bag;

(5) the cylindrical container inner bag according to any one of (1) to (4), in which the support mechanism has a length substantially equal to the diameter of a circle having the inner circumferential length of the inner bag;

(6) the cylindrical container inner bag according to any one of (1) to (5), in which the support mechanism is arranged in parallel with the bottom of the inner bag;

(7) the cylindrical container inner bag according to any one of (1) to (6), in which the support mechanism is arranged at the center of the inner bag in a width direction thereof;

(8) the cylindrical container inner bag according to any one of (1) to (7), which further includes an inlet/output port at an upper portion of the inner bag; and (9) a composite container including a cylindrical container and the cylindrical container inner bag according to any one of (1) to (8), in which the width of the inner bag is substantially the half of the inner circumferential length of the cylindrical container and the support mechanism regulates the position of the bottom of the inner bag in the cylindrical container such that the bottom of the inner bag is positioned on the vicinity of the center of the bottom of the cylindrical container.

Effects of the Invention

The cylindrical container inner bag of the present invention has, below the filler housing portion, the support mechanism portion having the function of regulating the position of the bottom of the inner bag in the cylindrical container. Thus, when the inner bag is housed in the cylindrical container, the bottom of the inner bag is positioned on the vicinity of the center of the bottom of the cylindrical container. When filled with the filler, the inner bag housed in the cylindrical container can be easily filled with the filler to the substantially same capacity as that of the cylindrical container without bending in the cylindrical container. Moreover, e.g., the process of lifting the inner bag filled with the filler is not necessary, and therefore, there is no probability that the film is stretched and ruptured due to the weight of the filler upon lifting.

DESCRIPTION OF THE EMBODIMENTS

Hereinafter, the present invention will be described in detail. Note that the present invention is not limited to the following aspect and various aspects can be employed within such a scope that advantageous effects of the present invention are obtained.

[Cylindrical Container Inner Bag]

Figure 1:
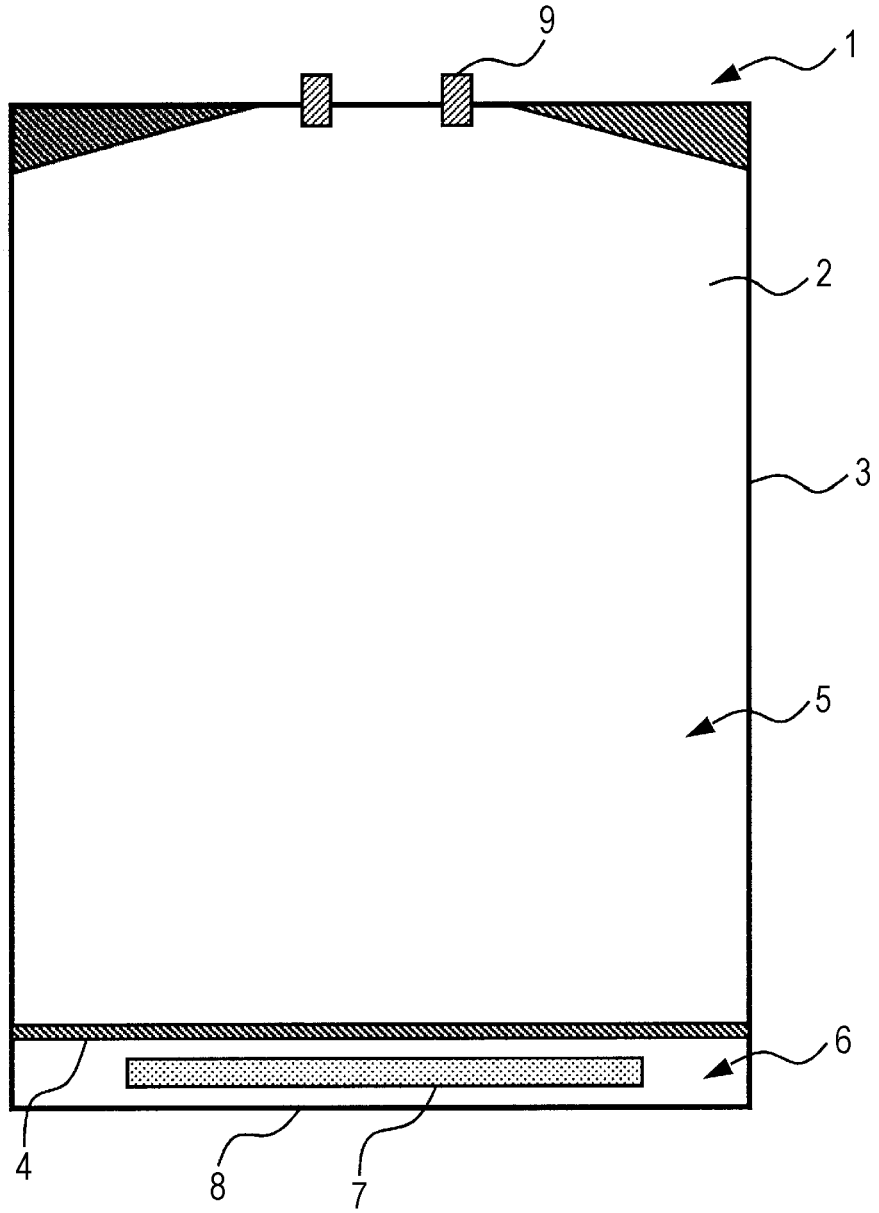
FIG. 1 is a front view of a cylindrical container inner bag according to a first embodiment of the present invention.

FIG. 1 is a front view of a cylindrical container inner bag in a first embodiment of the present invention. As shown in FIG. 1, the cylindrical container inner bag 1 of the present invention is formed in such a manner that one or more films 2 folded back or overlapping with each other are closed at least at a right or left end portion 3 or a lower portion 4, and has a filler housing portion 5 and a support mechanism portion 6 positioned below the filler housing portion 5.

The cylindrical container inner bag is a flat bag formed in such a manner that one or more films folded back or overlapping with each other are closed at least at a right or left end portion or a lower portion. The method for forming the bag closed at the right and left end portions and the lower portion is not specifically limited, and for example, includes a sealing method by thermal fusion bonding and a sealing method by means of an adhesive. Specific examples include, but not limited to, a method in which a film extruded in a tubular shape by, e.g., an inflation extrusion method is cut into a predetermined length and the cut film is sealed at a lower portion, a method in which two overlapping films are sealed at right and left end portions and a lower portion, and a method in which a single film folded in half is sealed at one of a right end portion or a left end portion and a lower portion. Note that the flat bag is one looking flat in a state in which the bag is not filled with a filler. The flat bag may be formed with a gusset or a fold, but is preferably formed with no gusset or no fold.

A film resin composition is not specifically limited. Resin typically utilized for an inner bag of a relatively-large capacity cylindrical container such as a drum can be used, and may include polyethylene-based resin such as linear low-density polyethylene, low-density polyethylene, and high-density polyethylene, polypropylene-based resin, ethylene-vinylalcohol copolymer resin, polyester-based resin, and nylon-based resin. The thickness of the film is not specifically limited, and is about 0.01 to 0.5 mm.

The cylindrical container inner bag has the filler housing portion 5 configured to house the filler inside and the support mechanism portion 6 formed below the filler housing portion 5 to regulate the position of the bottom 8 of the inner bag 1 in the cylindrical container, and the filler housing portion 5 and the support mechanism portion 6 are divided by a seal provided at the lower portion 4 of the inner bag. The filler housing portion is a space for housing the filler which is liquid or powder such as ink, a drug, or a vaccine, and may be designed to have the substantially same capacity as that of the cylindrical container.

The support mechanism portion 6 has a support mechanism 7 configured to regulate the position of the bottom 8 of the inner bag 1 in the cylindrical container. Regulation of the position of the bottom 8 of the inner bag 1 in the cylindrical container indicates that the bottom 8 of the inner bag 1 housed in the cylindrical container is positioned on the center of the bottom of the cylindrical container. For example, the support mechanism 7 having a length substantially equal to the diameter of a circle having the substantially same circumferential length as the inner circumferential length of the inner bag 1 (or the long axis of the bottom of the cylindrical container) is provided in the vicinity of the bottom 8 of the inner bag 1 so that the bottom 8 of the inner bag 1 in the cylindrical container can be regulated on the vicinity of the center of the bottom of the cylindrical container. With this configuration, the inner bag housed in the cylindrical container is not bent in the vicinity of the center of the bottom when filled with the filler, and therefore, a side surface (or front and back surfaces) of the inner bag can be equally pushed out and expanded by the weight of the filler and the inner bag can be fully filled with the filler. Note that it is difficult to precisely position the bottom of the inner bag on the center of the bottom of the cylindrical container. For this reason, the bottom of the inner bag may only be positioned on a center portion of the bottom of the cylindrical container within an area where a distance from the center of the bottom of the cylindrical container is 10%, preferably within an area where the distance from the center of the bottom of the cylindrical container is 5%, and more preferably within an area where the distance from the center of the bottom of the cylindrical container is 3%.

Figure 2:
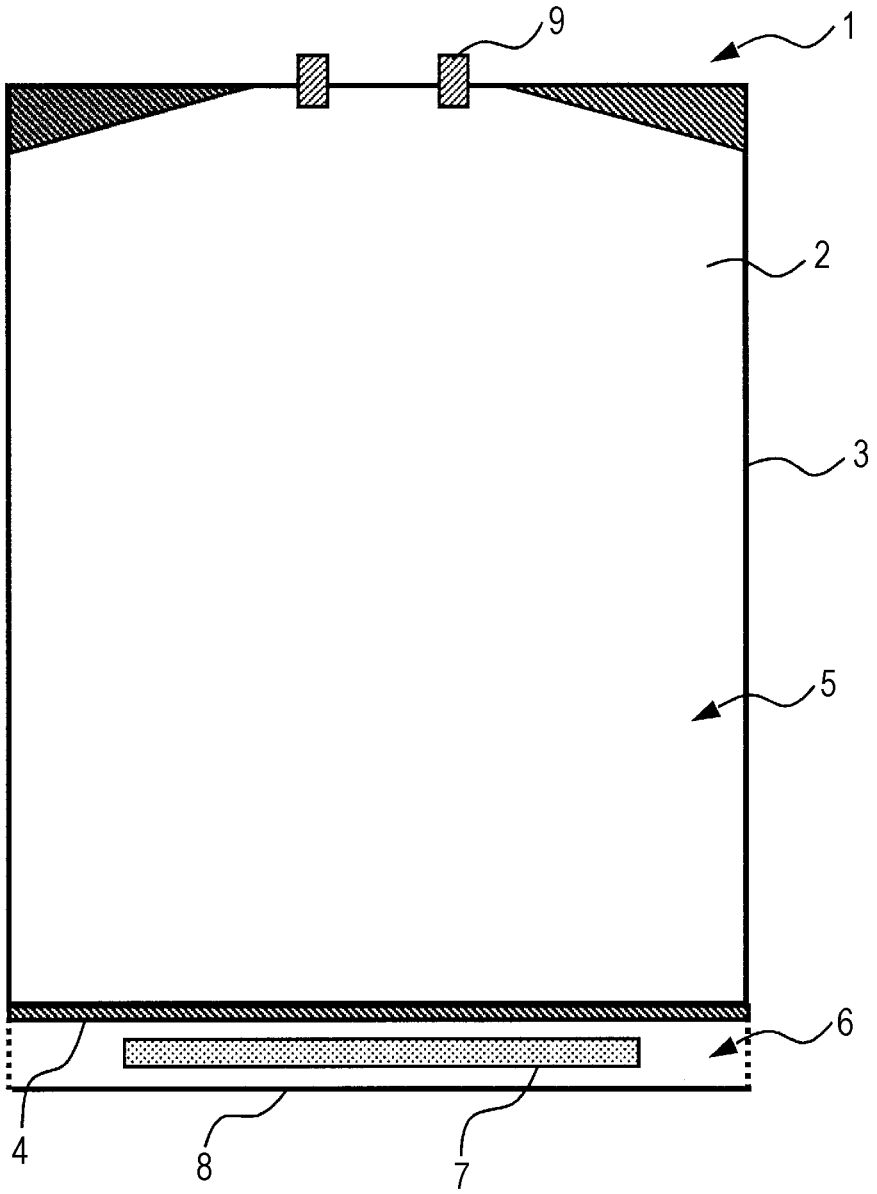
FIG. 2 is a front view of a cylindrical container inner bag according to a second embodiment of the present invention.

The support mechanism portion may have any configuration as long as the support mechanism portion has the support mechanism configured to regulate the position of the bottom of the inner bag in the cylindrical container as described above. For example, as shown in FIG. 1, it may be configured such that the seal is provided at the lower portion 4 of the inner bag, a housing space is provided between the lower portion 4 and the bottom 8 (or a bottom seal), the support mechanism 7 including a bar-shaped support member is arranged in the housing space. The support mechanism is not specifically limited as long as the support mechanism has such a level of stiffness (or strength) that the bottom of the inner bag is not bent due to, e.g., the weight of the filler, and examples thereof include paper, wood, synthetic resin, metal, and glass. Note that the bar shape indicates an elongated columnar shape, but is not precisely required as long as such a shape provides the function of regulating the position of the bottom of the inner bag in the cylindrical container. A support mechanism portion may be configured such that a housing space between a lower portion 4 and a bottom 8 opens at right and left end portions as shown in FIG. 2 for arranging a support mechanism after an inner bag has been formed.

Figure 3:
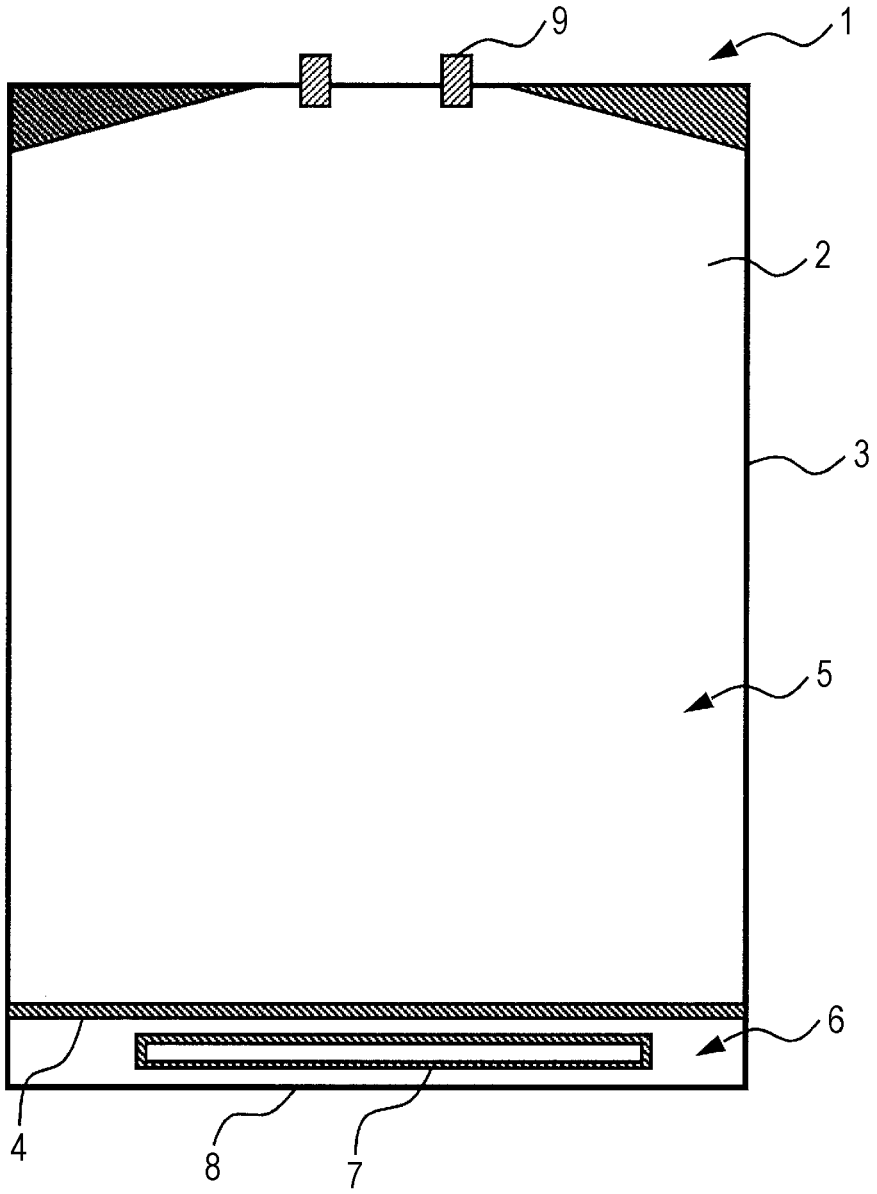
FIG. 3 is a front view of a cylindrical container inner bag according to a third embodiment of the present invention.

A support mechanism portion may be configured such that a seal is provided at a lower portion 4 of an inner bag 1 and a support mechanism 7 including a bar-shaped support space expanded by application of an internal pressure in such a manner that a hermetic space defined by, e.g., a seal is filled with, e.g., gas, liquid, or powder is arranged between the lower portion 4 and a bottom 8 (or a bottom seal), as shown in FIG. 3. The hermetic space may be integrated with the seals at the lower portion 4 and the bottom 8.

Figure 4:
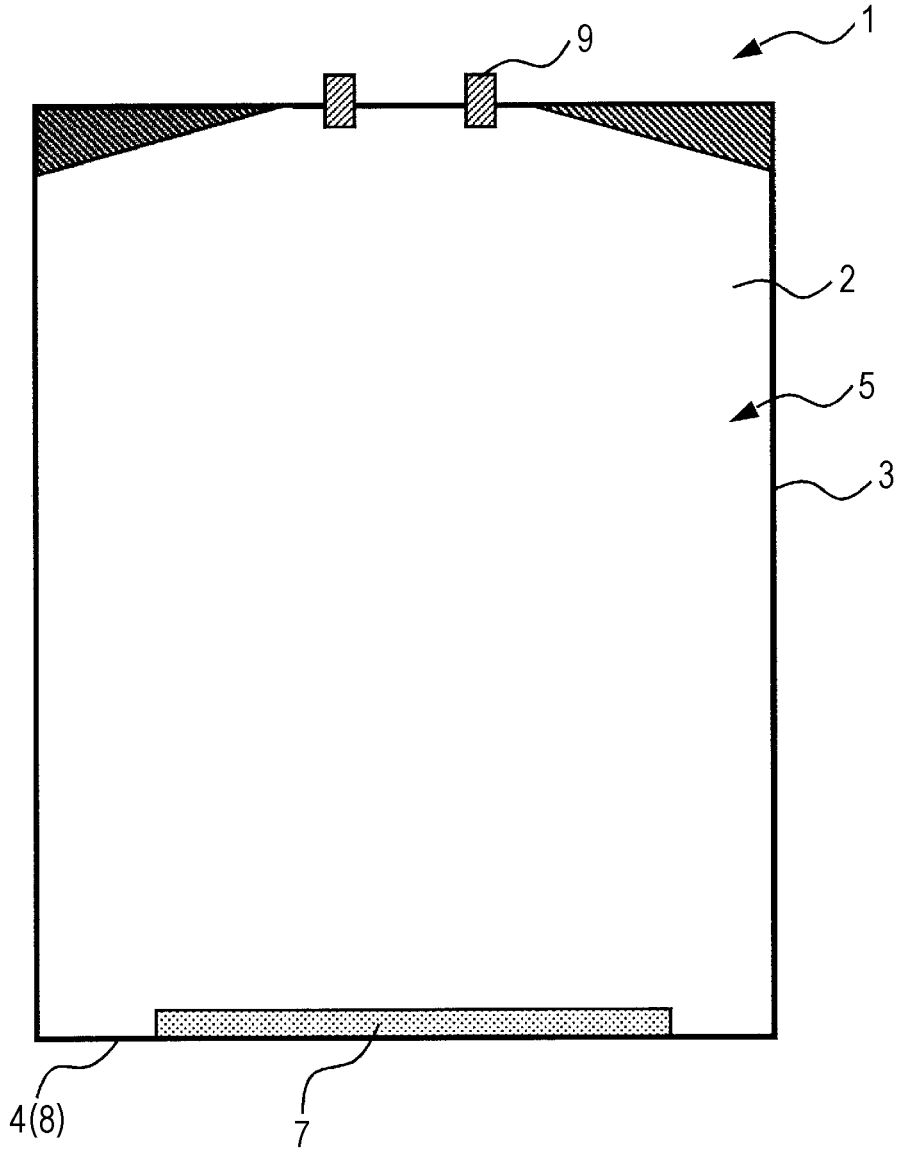
FIG. 4 is a front view of a cylindrical container inner bag according to a fourth embodiment of the present invention.
Figure 5:
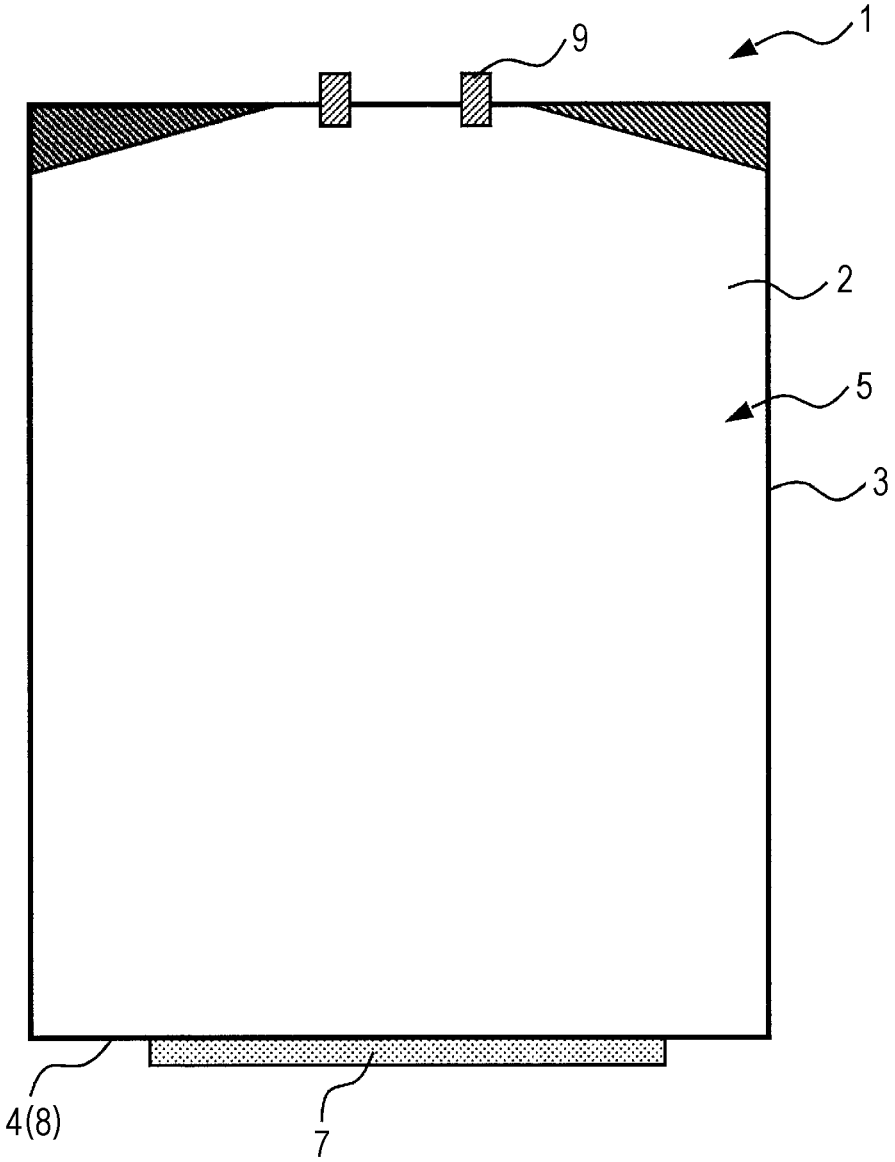
FIG. 5 is a front view of a cylindrical container inner bag according to a fifth embodiment of the present invention.

A support mechanism portion may be configured such that a support mechanism including a bar-shaped support member is arranged outside or inside the vicinity of the bottom of an inner bag. For example, as shown in FIGS. 4 and 5, it may be configured such that a seal (in this case, equivalent to the bottom of the bag) is provided at a lower portion 4 of the inner bag 1 and the support mechanism 7 (in this case, equivalent to the support mechanism portion) including the bar-shaped support member is fixed to the outside or inside of the vicinity of the bottom of the inner bag 1 by thermal fusion bonding, an adhesive, or a tool such as a clip. The support mechanism may only be fixed so that the bottom of the inner bag housed in a cylindrical container is positioned on the vicinity of the center of the bottom of the cylindrical container, and in this case, the support mechanism may be arranged immediately above or below the bottom. Note that the support mechanism may be formed integrally with the inner bag and, e.g., one formed in such a manner that a film portion below the seal at the lower portion 4 of the inner bag is wound in a roll shape and fixed in a bar shape may be employed as the support mechanism.

Figure 6:
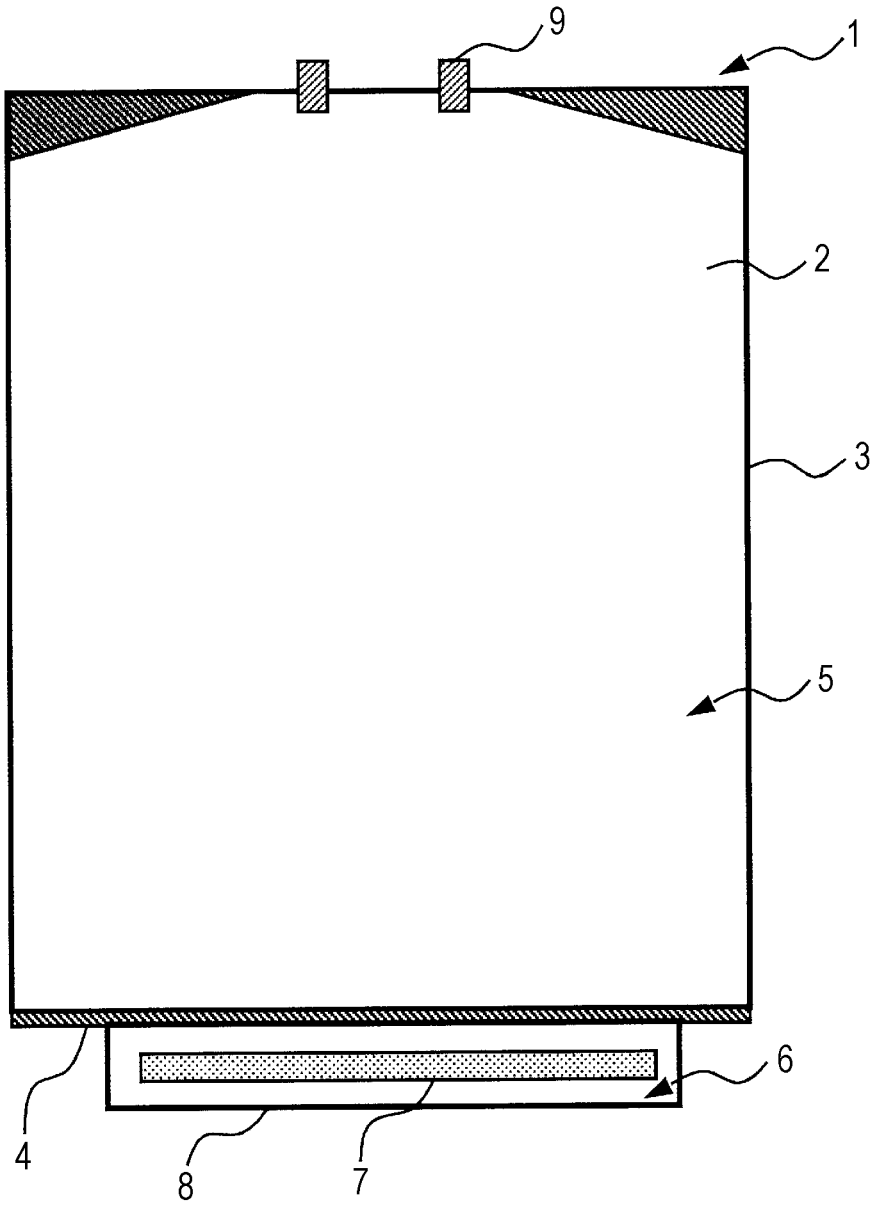
FIG. 6 is a front view of a cylindrical container inner bag according to a sixth embodiment of the present invention.
Figure 7:
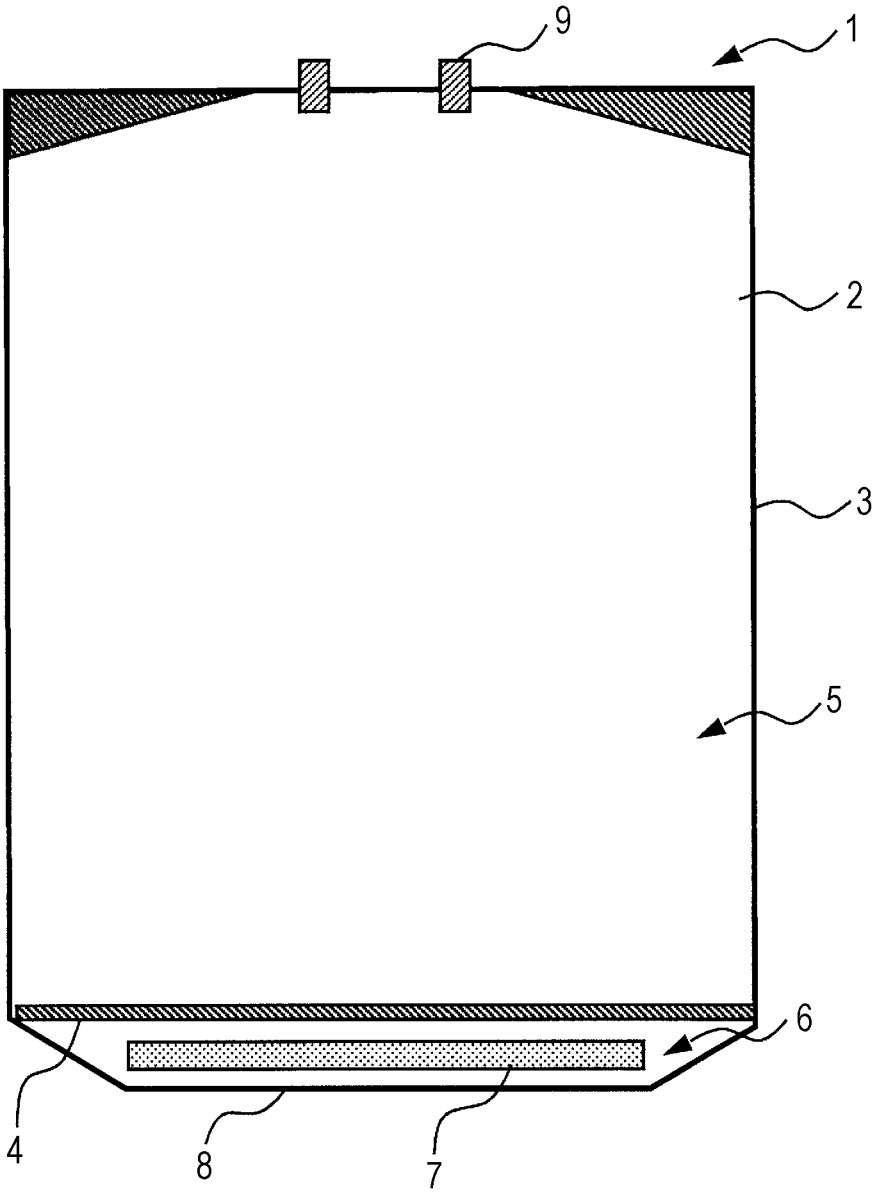
FIG. 7 is a front view of a cylindrical container inner bag according to a seventh embodiment of the present invention.

A support mechanism portion may be in a rectangular shape having a shorter length than the width of an inner bag as shown in FIG. 6, or may be in a trapezoidal shape narrowed toward the lower side of an inner bag as shown in FIG. 7. In this case, the length of the rectangular shape or the length of the short side of the trapezoidal shape is preferably a length substantially equal to the diameter of a circle having the inner circumferential length of the inner bag.

In the inner bag, the support mechanism is preferably arranged in parallel with the bottom of the inner bag. The support mechanism is arranged in parallel with the bottom of the inner bag so that the inner bag can be fully filled with the filler without bending in the vicinity of the center of the bottom in the cylindrical container when filled with the filler.

In the inner bag, the support mechanism is preferably arranged at the center of the inner bag in a width direction thereof. Since the support mechanism has the length substantially equal to the diameter of the circle having the inner circumferential length of the inner bag (or the long axis of the bottom of the cylindrical container), the support mechanism is shorter than the width of the inner bag by about 30%, and therefore, is preferably arranged 5% or more inside each of the right and left end portions of the inner bag, more preferably arranged 10% or more inside, and much more preferably arranged 15% or more inside. The method for fixing the position of the support mechanism in the width direction of the inner bag is not specifically limited, but the vicinities of both end portions of the support mechanism in the housing space may be sealed to fix the position of the support mechanism, for example.

The length of the support mechanism is preferably equal to or greater than 85% and equal to or less than 115% of the diameter of the circle having the inner circumferential length of the inner bag. The length of the support mechanism is more preferably equal to or greater than 90% and equal to or less than 105% of the diameter of the circle having the inner circumferential length of the inner bag, much more preferably equal to or greater than 90% and equal to or less than 100%, and still much more preferably equal to or greater than 95% and less than 100%. As long as the length of the support mechanism falls within the above-described range, the bottom of the inner bag can be positioned on the vicinity of the center of the bottom of the cylindrical container when the inner bag is housed in the cylindrical container.

An upper portion of the inner bag may be closed with a path for filling the inner bag with the filler being left open. Alternatively, it may be configured such that an inlet/output port 9 is provided at the upper portion of the inner bag. Multiple inlet/output ports may be provided at the upper portion of the inner bag.

[Composite Container]

Figure 8:
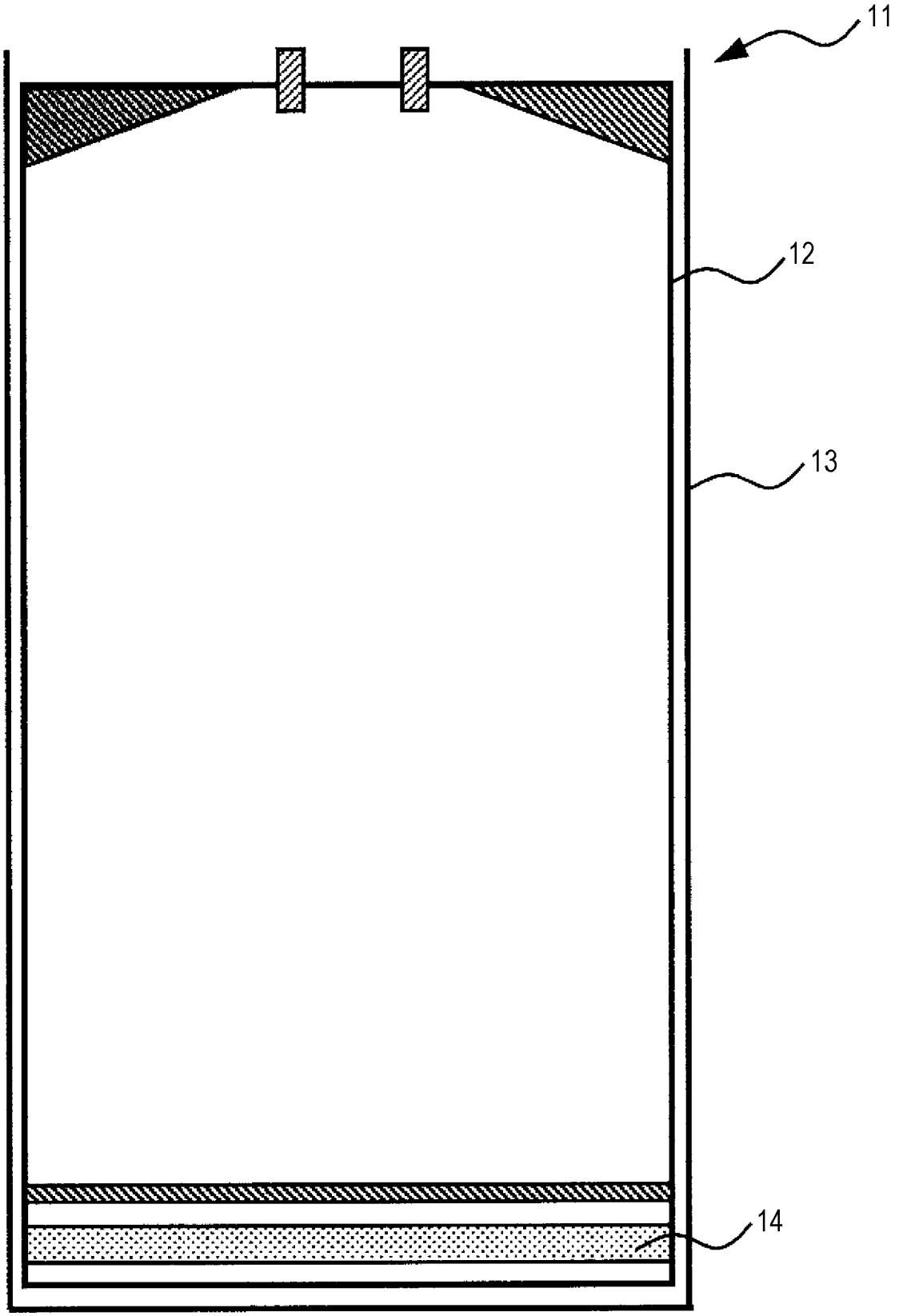
FIG. 8 is a sectional view of a composite container using a cylindrical container inner bag according to an embodiment of the present invention.
Figure 9:
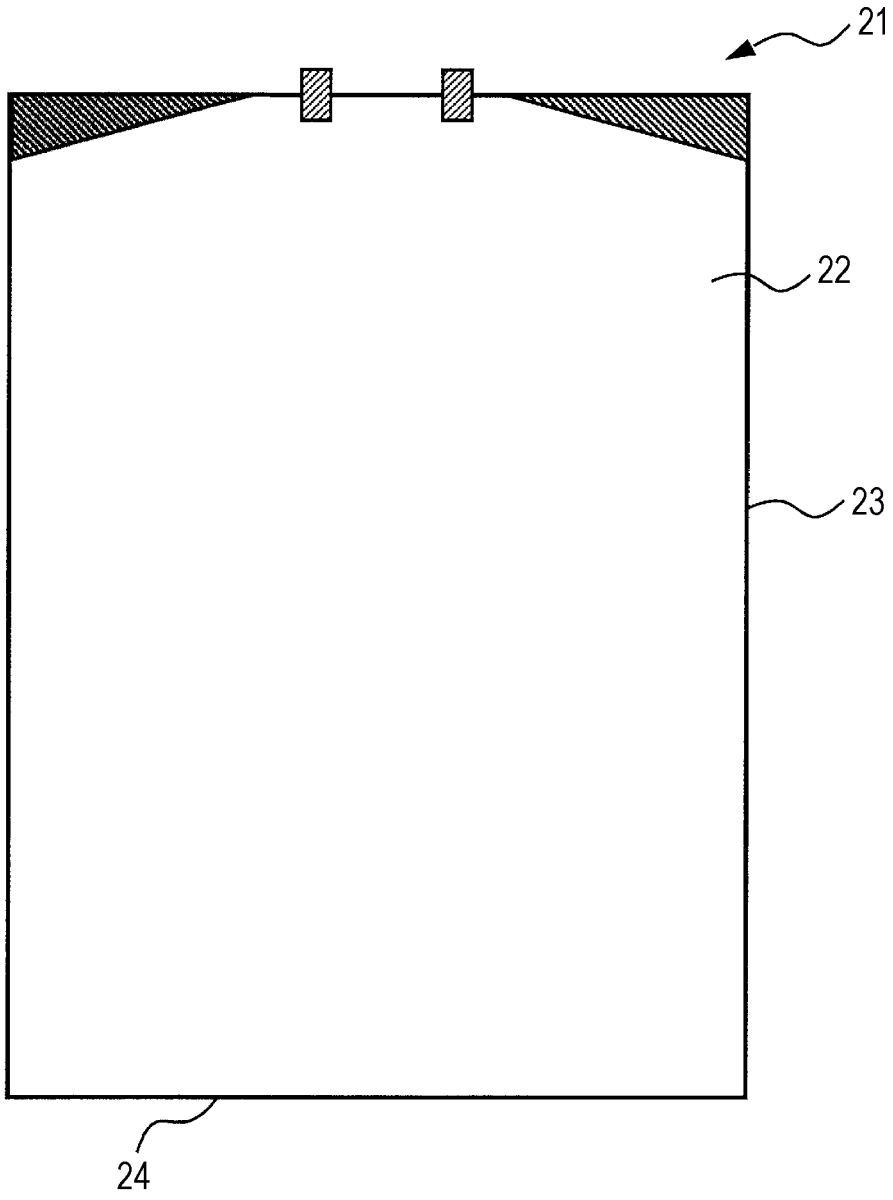
FIG. 9 is a front view of a typical cylindrical container inner bag.

FIG. 8 is a sectional view of a composite container using a cylindrical container inner bag according to an embodiment of the present invention. As shown in FIG. 8, the composite container 11 of the present invention includes a cylindrical container 13 and the cylindrical container inner bag 12, and the bottom of the inner bag is positioned on the vicinity of the center of the bottom of the cylindrical container by a support mechanism 14 of the inner bag. Since the bottom of the inner bag is positioned on the vicinity of the center of the bottom of the cylindrical container, the inner bag housed in the cylindrical container is not bent in the vicinity of the center of the bottom when filled with a filler, and therefore, a side surface of the inner bag is equally pushed out and expanded by the weight of the filler and the inner bag housed in the cylindrical container can be easily filled with the filler to the substantially same capacity as that of the cylindrical container.

The cylindrical container is a metal or plastic open drum having a relatively-large capacity of about 10 to 5000 L. An upper opening of the drum may be covered with a top plate (not shown), and in this manner, the drum may be sealed. In the case of providing the top plate at the upper opening, a hole for taking out a port of the inner bag may be provided at the top plate.

The width of the cylindrical container inner bag is substantially the half of the inner circumferential length of the cylindrical container. The width of the cylindrical container inner bag is preferably equal to or greater than 45% and equal to or less than 60% of the inner circumferential length of the cylindrical container, more preferably equal to or greater than 47.5% and equal to or less than 55%, and much more preferably equal to or greater than 47.5% and less than 52.5%. With this configuration, the inner bag is positioned along the cylindrical container when filled with the filler in the cylindrical container, and therefore, force applied to the inner bag due to the weight of the filler can be received by the container and damage of the inner bag due to the weight of the filler can be reduced.

The length of the support mechanism is preferably equal to or greater than 85% and equal to or less than 115% of the long axis of the bottom of the cylindrical container. The length of the support mechanism is more preferably equal to or greater than 90% and equal to or less than 105% of the long axis of the bottom of the cylindrical container, much more preferably equal to or greater than 90% and equal to or less than 100%, and still much more preferably equal to or greater than 95% and less than 100%. As long as the length of the support mechanism falls within the above-described range, the bottom of the inner bag can be positioned on the vicinity of the center of the bottom of the cylindrical container when the inner bag is housed in the cylindrical container.

First Example

A cylindrical container inner bag A having a capacity of 200 L as shown in FIG. 1 was produced using a polyethylene film with a thickness of 0.15 mm. The width of the inner bag was 860 mm, the height of a filler housing portion was 1450 mm, the height of a support mechanism portion (a housing space) was 50 mm, and a bar-shaped polyethylene support member (φ 10 mm, a length of 560 mm) was arranged (150 mm inside each of right and left end portions) at the center of the inner bag in a width direction thereof in the housing space.

After the inner bag A had been housed in a cylindrical container (φ 567 mm) with a capacity of 200 L, the bottom of the inner bag A was positioned on the center of the bottom of the cylindrical container. Subsequently, the inner bag A was filled with a filler as liquid through an upper opening of the inner bag A. Thereupon, a side surface of the inner bag was equally pushed out and expanded by the weight of the filler without the inner bag bending in the vicinity of the center of the bottom, and the inner bag housed in the cylindrical container could be easily filled with the filler to the substantially same capacity as that of the cylindrical container.

First Reference Example

A similar cylindrical container inner bag B was produced, except that the length of a support mechanism was changed to 500 mm. After the inner bag B had been housed in a cylindrical container with a capacity of 200 L, the bottom of the inner bag B was positioned on a location slightly shifted from the center of the bottom of the cylindrical container. Subsequently, the inner bag B was filled with a filler as liquid through an upper opening of the inner bag B. Thereupon, the inner bag tilted and leaned on the cylindrical container, and for this reason, the inner bag could not be fully filled with the filler.

LIST OF REFERENCE NUMERALS

1: Cylindrical Container Inner Bag
2: Film
3: Right and Left End Portions
4: Lower Portion
5: Filler Housing Portion
6: Support Mechanism Portion
7: Support Mechanism
8: Bottom
9: Inlet/Output Port
11: Composite Container
12: Cylindrical Container Inner Bag
13: Cylindrical Container
14: Support Mechanism
21: Inner Bag
22: Film
23: Right and Left End Portions
24: Bottom

What is claimed is:

1. A composite container comprising:

a cylindrical container; and a cylindrical container inner flat bag formed in such a manner that one or more films folded back or overlapping with each other are closed at least at a right or left end portion or a lower portion, comprising:

a filler housing portion; and a support mechanism portion positioned below the filler housing portion, wherein the filler housing portion and the support mechanism portion are divided by a seal provided at the lower portion, the support mechanism portion has a support mechanism comprising a bar-shaped support member, and the support mechanism is configured to regulate a position of a bottom of the inner bag in a cylindrical container, and the bar-shaped support member has an elongated columnar shape, wherein a width of the inner bag is substantially a half of an inner circumferential length of the cylindrical container, and the support mechanism regulates the position of the bottom of the inner bag in the cylindrical container such that the bottom of the inner bag is positioned on a vicinity of a center of a bottom of the cylindrical container.

2. The composite container according to claim 1, wherein the bar-shaped support member is arranged in a housing space.

3. The composite container according to claim 1, wherein the support mechanism includes a bar-shaped support space formed in such a manner that a hermetic space is expanded by an internal pressure.

4. The composite container according to claim 1, wherein the bar-shaped support member is arranged outside or inside a vicinity of the bottom of the inner bag.

5. The composite container according to claim 1, wherein the support mechanism has a length substantially equal to a diameter of a circle having an inner circumferential length of the inner bag.

6. The composite container according to claim 1, wherein the support mechanism is arranged in parallel with the bottom of the inner bag.

7. The composite container according to claim 1, wherein the support mechanism is arranged at a center of the inner bag in a width direction thereof.

8. The composite container according to claim 1, further comprising:

an inlet/output port at an upper portion of the inner bag.

9. The composite container according to claim 1, wherein the bar-shaped support member comprises one or more of paper, wood, synthetic resin, metal, or glass.

* * * * *